US006579138B2

(12) United States Patent
Kawashima et al.

(10) Patent No.: US 6,579,138 B2
(45) Date of Patent: Jun. 17, 2003

(54) BUOYANCY REGULATOR FOR DIVING

(75) Inventors: Haruo Kawashima, Tokyo (JP); Kenji Kawana, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/072,964

(22) Filed: Feb. 12, 2002

(65) Prior Publication Data

US 2002/0111096 A1 Aug. 15, 2002

(30) Foreign Application Priority Data

Feb. 15, 2001 (JP) ..... 2001-039126

(51) Int. Cl.[7] ..... B63C 9/08

(52) U.S. Cl. ..... 441/116; 441/111; 405/186

(58) Field of Search ..... 441/96, 111, 116; 405/186

(56) References Cited

U.S. PATENT DOCUMENTS 5,346,419 A * 9/1994 Kaiser ..... 441/96

* cited by examiner

*Primary Examiner*—Jesus D. Sotelo
(74) *Attorney, Agent, or Firm*—Clark & Brody

(57) ABSTRACT

A buoyancy regulator for diving includes a cylinder band for fixation of an air cylinder. The cylinder band comprises a belt-like part and a buckle which is formed with a plurality of band insertion slits arranged in a longitudinal direction of the cylinder band. Each pair of side walls respectively lying on both sides of each of the insertion slits is marked with the same letters indicating a sequence in which the belt-like part should be inserted through the buckle.

4 Claims, 4 Drawing Sheets

BUOYANCY REGULATOR FOR DIVING

BACKGROUND OF THE INVENTION

This invention relates to a buoyancy regulator for diving including a cylinder band adapted to fasten an air cylinder to a rear side of a jacket.

A buoyancy regulator for diving is well known, which comprises a jacket adapted to be inflated by buoyancy regulating air and a back-plate mounted on a rear side of the jacket adapted to fix an air cylinder to the back-plate by fastening a cylinder band extending in a transverse direction of the back-plate. The cylinder band conventionally comprises a belt-like part extending in the transverse direction of the back-plate and a buckle connected by means of a connector to one of longitudinally opposite ends of the belt-like part. This buckle has a plurality of insertion slits so that the other end of the belt-like part may be successively invited through these insertion slits. Between respective pairs of adjacent insertion slits, the buckle is provided with partition walls arranged in a longitudinal direction of the belt-like part. These partition walls are respectively marked with numerals 1, 2, 3 . . . or letters A, B, C . . . so that the free end of the belt-like part may be successively carried through these insertion slits in the order indicated by these numerals or letters to fix the air cylinder to the back-plate.

With the buoyancy regulator for diving as has been described above, the diver may sometimes waver in judgement to select the right or left insertion slit with respect to each of the partition walls when it is desired for the diver to insert the free end through an appropriate one of the insertion slits. This is true particularly for divers who are unaccustomed to handling of the buoyancy regulator for diving and such divers are apt to select the insertion slits in an improper order.

SUMMARY OF THE INVENTION

It is an object of this invention to improve the above-described buoyancy regulator for diving so that it assures even an inexperienced diver to insert a free end of a belt-like part of a cylinder band through a plurality of insertion slits in a proper order.

According to this invention, there is provided a buoyancy regulator for diving comprising a jacket adapted to be inflated by buoyancy regulating air, a back-plate mounted on a rear side of the jacket and a cylinder band extending in a transverse direction of the back-plate and adapted to fix an air cylinder to the back-plate.

The band further comprises a belt-like part extending in a transverse direction of the back-plate, a connector attached to one end of the belt-like part and being sufficiently wider than the belt-like part to allow the other end of the belt-like part to be guided therethrough and a buckle attached to one end of the belt-like part by means of the connector, wherein the buckle has a plurality of band insertion slits extending in a transverse direction of the belt-like part and arranged in a longitudinal direction of the belt-like part so that the other end may be sequentially inserted through these insertion slits and the buckle includes regions defining side walls of the band insertion slits respectively wherein each pair of neighboring regions is marked with the same letters indicating a sequence in which the other end should be inserted through. Meanwhile, the same letters referred to in this invention mean the letters which can be recognizable as practically the same in the use of the buoyancy regulator.

DETAILED DESCRIPTION OF THE PREFERRED EMBODIMENTS

Details of a buoyancy regulator for diving according to this invention will be more fully understood from the description given hereunder in reference to the accompanying drawings.

Figure 1:
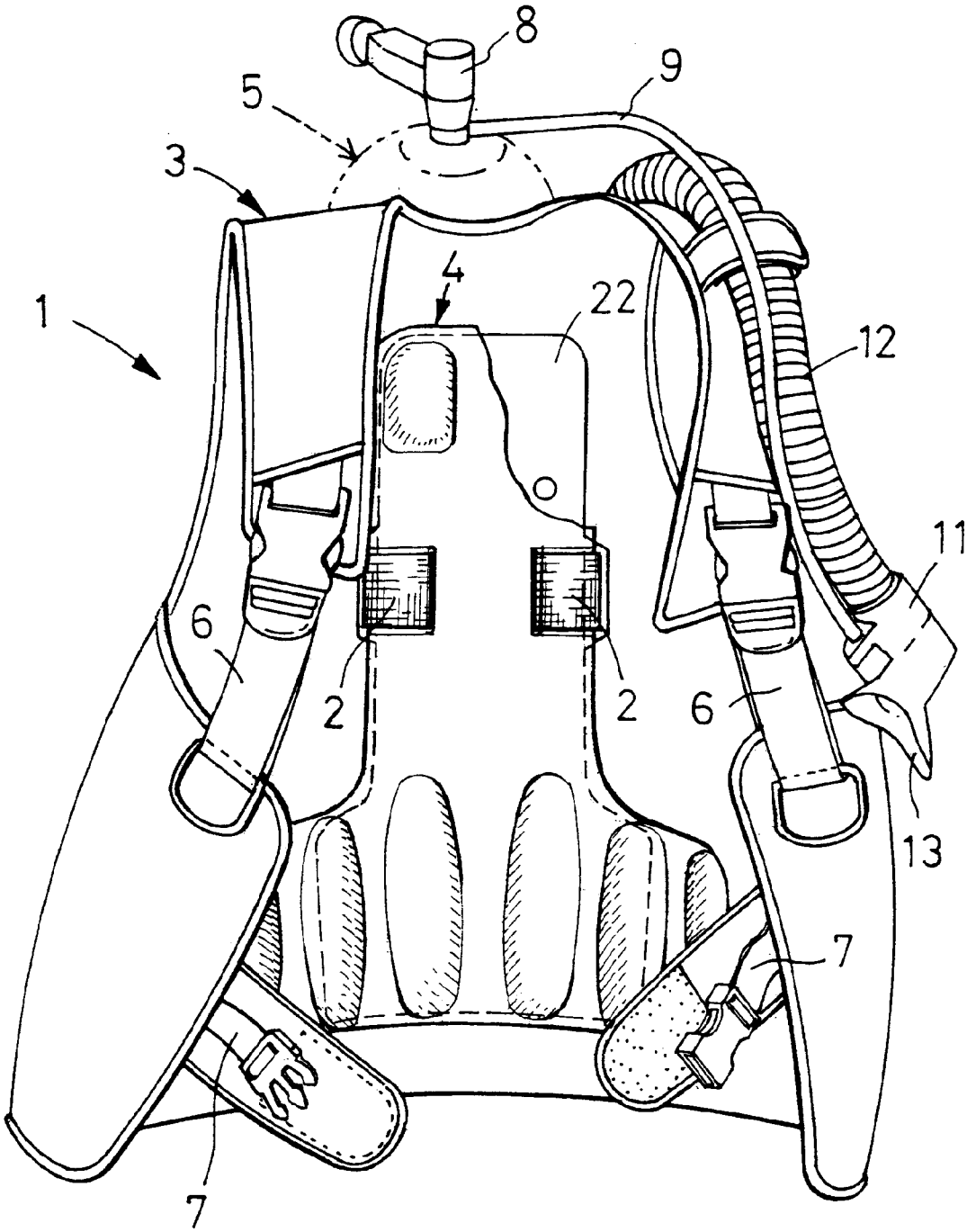
FIG. 1 is a front view of a buoyancy regulator according to this invention as partially cut-away.
Figure 2:
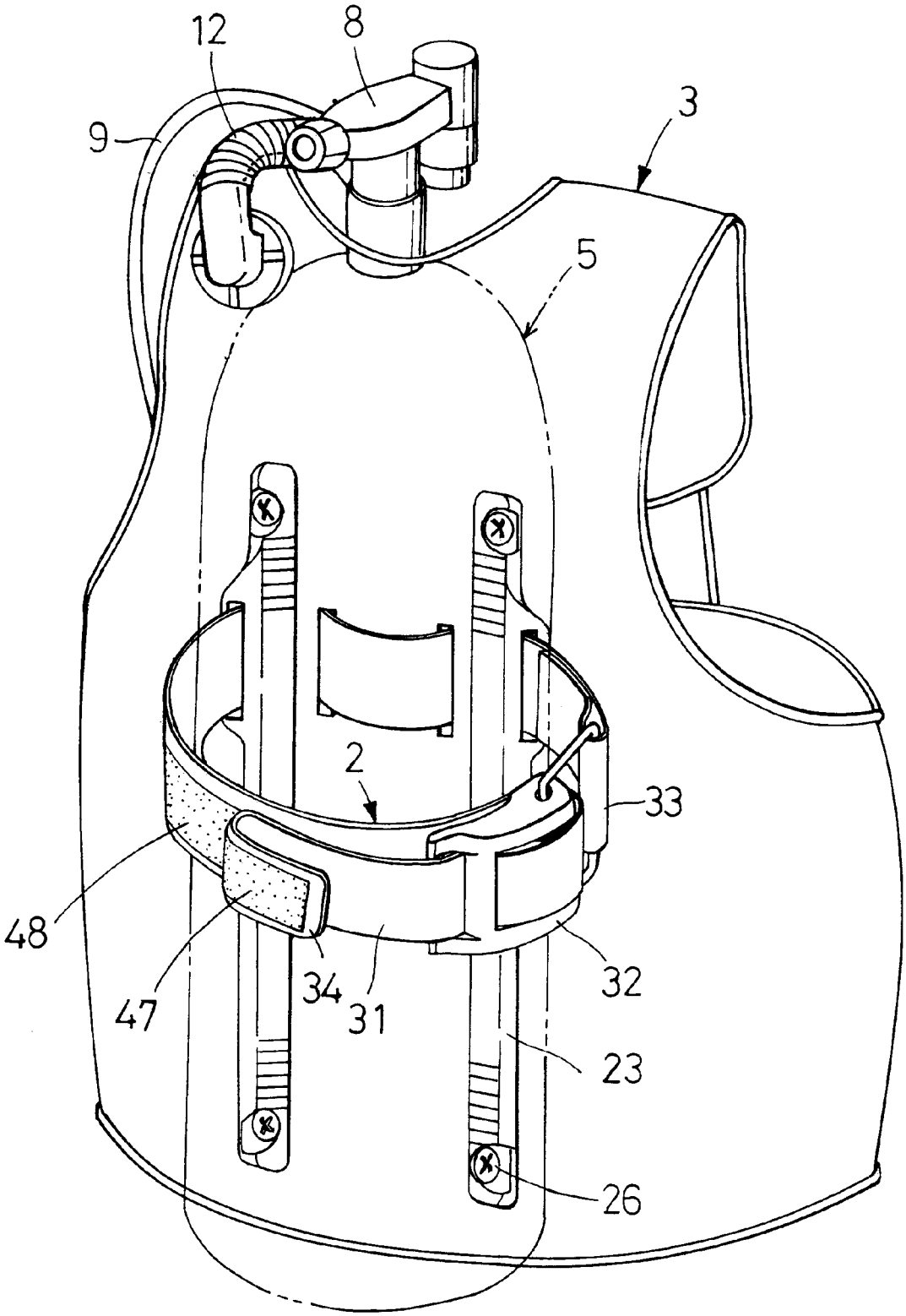
FIG. 2 is a perspective view of the buoyancy regulator as viewed from its rear side.

FIGS. 1 and 2 are front and rear views of a buoyancy regulator 1, respectively, in which an air cylinder 5 is mounted on the regulator 1 as indicated by imaginary lines. In FIG. 1, the regulator 1 is shown as partially broken away.

The buoyancy regulator 1 includes a jacket 3 adapted to be inflated by buoyancy regulating air, a cylinder band 2, a cushion pad 4 and a back-plate 22 covered with the cushion pad 4. A diver can wear the jacket 3 with a shoulder belt 6 and a waist belt 7 by adequately adjusting their length. The air cylinder 5 is provided on its top with a first stage 8 from which a regulator hose 9 extends to a second stage 11 from which, in turn, an inflation hose 12 extends to a rear side of the jacket 3. A mouthpiece 13 is mounted on the second stage 11. The cylinder band 2 comprises a belt-like part 31 extending in a transverse direction of the back-plate 22 first from an outer side to an inner side, then from the inner side to the outer side, again from the outer side to the inner side and finally from the inner side to the outer side of a rear body of the jacket 3 and a buckle 32 mounted on one end of the belt-like part 31. The air cylinder 3 can be fixed to the back-plate 22 by properly adjusting the length of the cylinder band 2 by means of the buckle 32. The back-plate 22 is positioned on an inner surface of a rear side of the jacket 3 and cooperates with a part of fittings 23 vertically extending on an outer surface of the rear side of the jacket 3 so as to squeeze the cloth of the jacket 3. The back-plate 22 and the fittings 23 are fixed to the jacket by means of bolts 26 and nuts (not shown).

Figure 3:
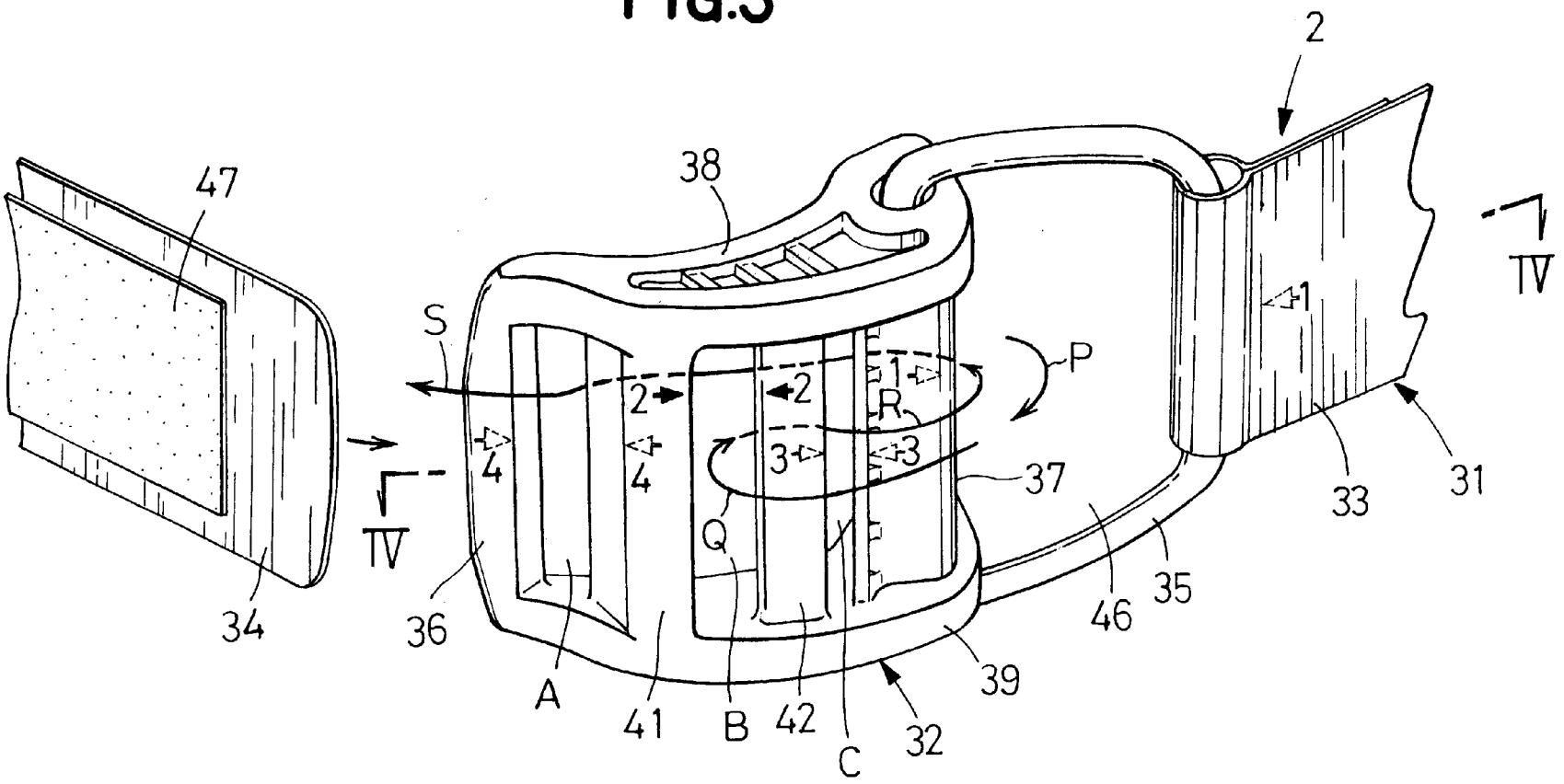
FIG. 3 is a fragmentary view of the cylinder band.

FIG. 3 is a fragmentary perspective view of the cylinder band 2. At one end 33 of the belt-like part 31 constituting the band 2 together with the buckle 2, the buckle 32 is connected to the belt-like part 31 by means of a connector 35. The end opposed to the end 33 defines a free end 34 adapted to be inserted through slits of the buckle 32. The connector 35 is formed by bending a metallic round bar so that the end 33 of the belt-like part 31 is spaced from a rear end 37 of the buckle 32 to define a space gap 46 therebetween through which the free end 34 of the belt-like part 31 can be inserted. The connector 34 is configurated to be wider in dimension than the belt-like part 31. The belt-like part 31 and the buckle 32 are able to rotate around portions of the connector 35 vertically extending portions as axis of rotation, respectively. The buckle 32 has a front end 36 facing the side of the free end 34 of the belt-like part 31, the rear end 37 facing the side of the connector 35, upper and lower edges 38, 39 both connecting these front and rear ends 36, 37, and three rows of band insertion slits A, B, C extending to the width direction of the belt-like 31 (in the vertical direction as viewed in FIG. 3) and arranged in the longitudinal direction of the belt-like part 31. A pair of the adjacent insertion slits A and B are separated from each other by a first side wall 41 and a pair of the adjacent insertion slits B and C are separated from each other by a second side wall 42. A side wall defined by the front end 36 of the buckle 32 and the first side wall 41 lie on both sides of the insertion slit A, the first and second side walls 41, 42 lie on both sides of the insertion slit B, and the second side wall 42 and a side wall defined by the rear end 37 of the buckle 32 lie on both sides of the insertion slit C. These front and rear ends 36, 37 as well as the first and second side walls 41, 42 respectively have inner surfaces facing the air cylinder 5 and outer surface facing away from the air cylinder 5. These inner and outer surfaces are respectively marked with signs composed of numerals 1–4 and arrows in a manner as follows: the front end 36 is marked on its inner surface with a numeral 4 and an arrow pointing to the insertion slit A; the first side wall 41 is marked on its inner surface with a numeral 4 and an arrow pointing to the insertion slit A; the first side wall 41 is marked on its outer surface with a numeral 2 and an arrow pointing to the insertion slit B; the second side wall 42 is marked on its inner surface with a numeral 3 and an arrow pointing to the insertion slit C; the second side wall 42 is marked on its outer surface with a numeral 2 and an arrow pointing to the insertion slit B; and the rear end 37 is marked on its inner surface with numeral 3 and an arrow pointing the insertion slit C. In addition, the end 33 opposed to the rear end 37 of the buckle 32 with the space gap 46 therebetween is preferably marked on its inner surface facing the air cylinder 5 with a numeral 1 and an arrow pointing to the space gap 46.

Figure 4:
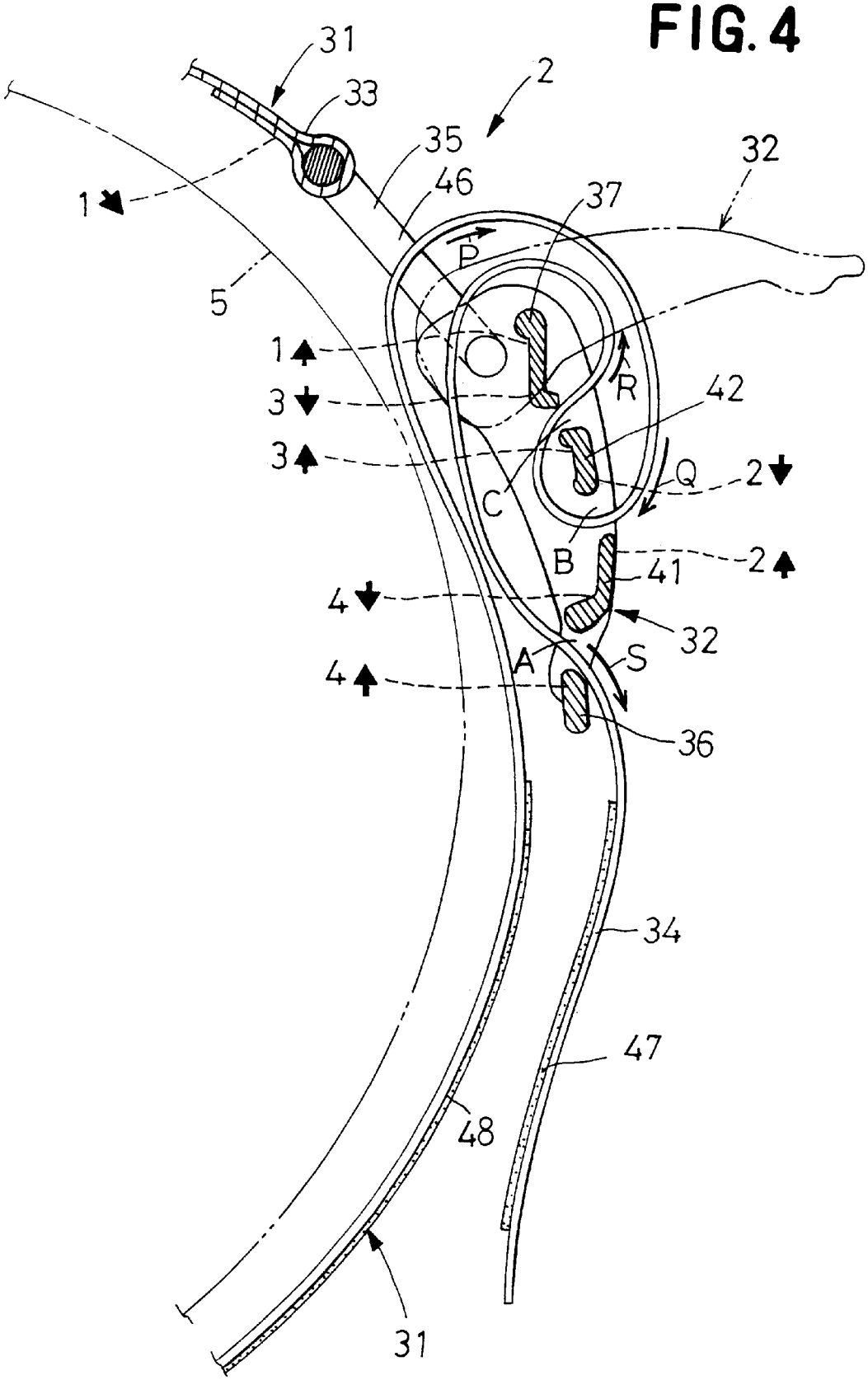
FIG. 4 is a cross-sectional view taken along a line IV–IV in FIG. 3.

FIG. 4 is a cross-sectional view taken along a line IV–IV in FIG. 3, in which the belt-like part 31 of the band 2 inserted through the slits of the buckle 32 is indicated by solid lines and regions having the numerals 1–4 and the arrows marked thereon, respectively, are indicated by outgoing lines. To fix the air cylinder 5, the buckle 32 is first retained in a position slightly lifted with respect to the air cylinder 5 as indicated by an imaginary line. Then the free end 34 of the belt-like part 31 is invited to the space gap 46 and the insertion slits A to C successively following the arrows indicated in combination with the respective numerals 1–4 in the order of these numerals 1–4 marked on the belt-like part 31 and the buckle 32. More specifically, the free end 34 is invited to the space gap 46 from the inner side toward the outer side of the buckle 32, then guided to the directions indicated by arrows P, Q, R, S so as to progressively clamp the air cylinder 5 and strongly pulled after the free end 34 has been inserted through the insertion slit A. Thereupon the buckle 32 is collapsed as indicated by a solid line and finally a male member 47 (See FIG. 3 also) attached to one surface of the free end 34 as a component of a mechanical fastener well known by the trade name of Magic Tape or the like is engaged with a female member 48 attached to the opposed surface of the belt-like part 31 as another component of the mechanical fastener to complete fastening of the air cylinder 5.

According to this invention, the front end 36 defining a side wall and the first side wall 41 lie on both sides of the insertion slit A, the first side wall 41 and the second side wall 42 lie on both sides of the insertion slit B and the second side wall 42 and the rear end 37 defining a side wall lie on both sides of the insertion slit C. Each pair of the adjacent side walls may be marked on inner surfaces and/or outer surfaces of these adjacent side walls with same numerals or letters, for example, Roman characters indicating the sequence of insertion, and preferably these letters may be combined with signs such as arrows. The diver may select the insertion slits lying between the pairs of the adjacent letters and signs such as arrows in the order indicated by these letters and signs and insert the belt-like part 31 in a proper order through the slits from the inner or outer side bearing these letters and signs. In this way, the air cylinder 5 can be reliably fixed to the back-plate 22 without erroneous handling of the cylinder band 2. In one preferred embodiment, the end 33 of the belt-like part 31 opposed to the rear end 37 of the buckle 32 is also marked with letters and signs.

The buoyancy regulator for diving according to this invention allows the diver to fix the cylinder to the back-plate without erroneous handling of the cylinder band. This is achieved by the unique arrangement such that each pair of the adjacent side walls defining both sides of each insertion slit of the buckle may be marked on inner surfaces and/or outer surfaces of these adjacent side walls with same letters or same letters and signs indicating the sequence of insertion. The diver may select the insertion slits lying between the pairs of the adjacent letters or the letters and signs in the order indicated by these letters or letters and signs and insert the belt-like part of the band in a proper order through the slits.

What is claimed is:

1. A buoyancy regulator for diving comprising:

a jacket adapted to be inflated by buoyancy regulating air, a back-plate mounted on a rear side of said jacket and a cylinder band extending in a transverse direction of said back-plate and adapted to fix an air cylinder to said back-plate;

said band comprising a belt-like part of said cylinder band extending in a transverse direction of said back-plate, a connector attached to one end of said belt-like part and being sufficiently wider than said belt-like part to allow the other end of said belt-like part to be guided therethrough and a buckle attached to said one end of said belt-like part of said part by means of said connector; and said buckle having a plurality of band insertion slits extending in a transverse direction of said belt-like part and arranged in a longitudinal direction of said belt-like part so that said other end is sequentially inserted through these insertion slits and said buckle includes regions defining side walls of respective said band insertion slits wherein each pair of adjacent said regions is marked with the same letters indicating a sequence in which said other end should be inserted through said band insertion slits.

2. The buoyancy regulator according to claim 1, wherein each pair of said adjacent regions defining said side walls is marked with, in addition to said letters, identically shaped signs opposed to each other with said insertion slit therebetween.

3. The buoyancy regulator according to claim 1, wherein said buckle has at least three said insertion slits and at least four said regions defining said side walls, two of which define front and rear ends of said buckle, respectively.

4. The buoyancy regulator according to claim 1, wherein said regions defining said side walls have inner surfaces facing said air cylinder and outer surfaces facing away from said air cylinder so that said letters are marked on said inner surfaces for the insertion slits through which said other end is inserted from the side of said inner surfaces and said letters are marked on said outer surfaces for the insertion slits through which said other end is inserted from the side of said outer surfaces.

* * * * *